US006578291B2

(12) United States Patent
Hirsch et al.

(10) Patent No.: US 6,578,291 B2
(45) Date of Patent: Jun. 17, 2003

(54) SHOE WEAR INDICATOR

(76) Inventors: John Hirsch, 17 Hawkes St., Marblehead, MA (US) 01945; Joshua Horwitz, 85 Lexington Ave., Magnolia, MA (US) 01930; Ron Zolla, 15 Brookside Rd., Topsfield, MA (US) 01983

( * ) Notice: Subject to any disclaimer, the term of this patent is extended or adjusted under 35 U.S.C. 154(b) by 0 days.

(21) Appl. No.: 09/875,693

(22) Filed: Jun. 6, 2001

(65) Prior Publication Data

US 2001/0049890 A1 Dec. 13, 2001

Related U.S. Application Data

(60) Provisional application No. 60/209,661, filed on Jun. 6, 2000.

(51) Int. Cl.[7] ..... A43B 5/00; A43B 23/00

(52) U.S. Cl. ..... 36/132; 36/137; 36/136

(58) Field of Search ..... 36/132, 30 R, 36/25 R, 136, 139, 137

(56) References Cited

U.S. PATENT DOCUMENTS 4,402,147 A * 9/1983 Wu ..... 36/136
4,510,704 A * 4/1985 Johnson ..... 36/136
5,230,249 A * 7/1993 Sasaki et al. ..... 36/132
5,373,651 A * 12/1994 Wood ..... 36/136
5,500,635 A * 3/1996 Mott ..... 36/137
5,640,786 A * 6/1997 Buyayez ..... 36/132
5,661,916 A * 9/1997 Huang ..... 36/132
5,797,201 A * 8/1998 Huang ..... 36/132
5,875,571 A * 3/1999 Huang ..... 36/132
5,929,332 A * 7/1999 Brown ..... 36/136
5,945,911 A * 8/1999 Healy et al. ..... 36/137

FOREIGN PATENT DOCUMENTS

EP 522882 * 1/1993 ..... 36/137

* cited by examiner

*Primary Examiner*—Anthony D. Stashick

(57) ABSTRACT

The invention provides a shoe having a built-in, electronic wear indicator device capable of signaling (a) extent of shoe sole wear, (b) loss of ability to cushion and absorb shock, and (c) a need to replace the shoe. The wear indicator device comprises (a) a sensor and microprocessor which can measure and report the use history of the shoe, (b) a wear indicator display which shows the consumer the current point in the shoe's life cycle and (c) a power source. The wear indicator device is installed between the midsole and outsole during the manufacturing process and is therefore, built-in and unobtrusive to the user.

10 Claims, 6 Drawing Sheets

SHOE WEAR INDICATOR

This Application claims benefit of Provisional Application No. 60/209,661 filed Jun. 6, 2000.

FIELD OF THE INVENTION

The present invention relates generally to athletic shoes including running shoes, aerobics class exercise shoes, cross-training shoes and specialized sports shoes such as tennis shoes and basketball shoes having a built-in capability of accurately measuring the useful life of the shoe and indicating the need for shoe replacement to the user. The device is placed in a shoe during manufacture or assembly. It has a built-in, electronic component sole wear indicator capable of showing shoe sole wear, remaining useful life of the shoe and advising the user when to replace the shoe.

DESCRIPTION OF THE PRIOR ART

Consumers of shoes, particularly athletic shoes, need to know when the shoes have lost their shock-absorbing capability and therefore, need to be replaced. Consumers will benefit by knowing when their athletic shoes need to be replaced with a new pair. On one hand, premature replacement creates an unwarranted expense, while on the other hand, delayed replacement can cause pain and lead to injury. For example, one authority places the useful life of a running shoe at between 300 and 500 miles (Running Injury Free, Ellis and Henderson, Rodale Press, 1994). Running shoes range in price from $60.00 to over $100.00 Premature replacement, for example at 200 miles, generates unnecessary expense. However, running on "spent" shoes can cause pain and injury, particularly in athletic applications and as people age. Therefore, consumers would benefit from an athletic shoe with the herein described wear indicator inside, a shoe equipped with an internal, unobtrusive device which reports both economic utility and functional utility of the shoe have been utilized.

Shoe wear indicators are known to the art. U.S. Pat. No. 5,894,682 issued to J. Broz discloses a built-in wear indicator comprised of a shoe having an outsole made of durable material to withstand contact and wear and a midsole made of cushioning material to absorb shock. The wear indicator consists of plugs of a less compactable material (i.e. a material that has a slower rate of breakdown, a smaller loss of resiliency and less compaction) installed in several locations in the midsole and extending into the outsole. According to Broz, as the midsole material breaks down and loses its ability to absorb shock, it compacts and contracts in the vertical dimension. The wear indicator, by virtue of breaking down more slowly and losing its compressibility less rapidly, retains its vertical dimension and consequently projects further out from the bottom of the midsole into the outsole in response to wear. With extended wear, the protrusion of the built-in wear indicator device into the outsole becomes detectable to the wearer upon inspection of the bottom of the shoe.

The device of the present invention measures wear. Such measurement is provided with a built-in electronic component wear indicator device that is more accurate than the device described in U.S. Pat. No. 5,894,682 because it is insensitive to terrain differences and does not rely upon outsole wear or midsole compaction. The invention does not rely on midsole material compaction is important because many athletic material midsoles include both elastic materials and pressurized gas or fluids. Thus, measuring midsole material compaction alone may not provide information when a fluid-filled bladder containing gas or liquid has lost its shock absorbing capacity. Further, it does not disturb the integrity of an athletic shoe's midsole or outsole as may be the case with multiple sole plugs of a less compactable material than the midsole installed about the midsole. In fact, one embodiment of the present invention is a thin strip of tape having electronic components disposed thereon which is placed between the midsole and outsole during the manufacturing process. Because of the very small size it does not intrude upon the integrity and performance characteristics of the shoe and is very easily installed between the midsole and outsole during the manufacturing process.

U.S. Pat. No. 3,578,055 to French et.al. discloses a tread wear indicator for automobile tires and U.S. Pat. No. 3,929,179 to Hines discloses a tread wear indicator device also incorporating the wear indicator into a tire. These devices measure tire life by assessing the physical wearing away of the tread similar to Broz's method of measuring midsole wear in a shoe.

Shoe step counting devices are found in the prior art. U.S. Pat. No. 4,019,030 to Tamiz discloses a mechanical device for counting and recording the number of steps taken by a pedestrian. An operating member projects below the heel and initiates actuation of a digital counter each time the heel is brought into contact with the ground. The objective of the invention is to measure distance traveled by noting the number of steps taken at the beginning and end of a walking session.

U.S. Pat. No. 4,402,147 to Wu discloses a shoe with a switch operatively arranged to produce an electrical signal in response to a user taking a step, an electronic counter means for counting electrical signals from the switch and an electronic display to show total number of steps taken and therefore, the distance traveled. U.S. Pat. No. 5,471,405 to Marsh discloses a measuring device embedded in a shoe that provides a force analysis that is recorded and used to determine real time force analysis calculations for the user.

One embodiment of the present invention measures steps taken by a user. The purpose of counting steps is to measure sole wear or, more specifically, the progressive fatigue of the midsole material and/or the loss of shock absorbing capability of either gas or liquid filled bladder. In one embodiment an ASIC (application specific integrated circuit) capable of counting, remembering and communicating the number of steps taken will be preset to the specific shoe application. A wear-indicator display visible to the user will show the progressive deterioration of the shoe as it progresses through its useful life. Similar in principle to an automobile fuel gauge the user will know when the shoe should be replaced.

Figure 1A:
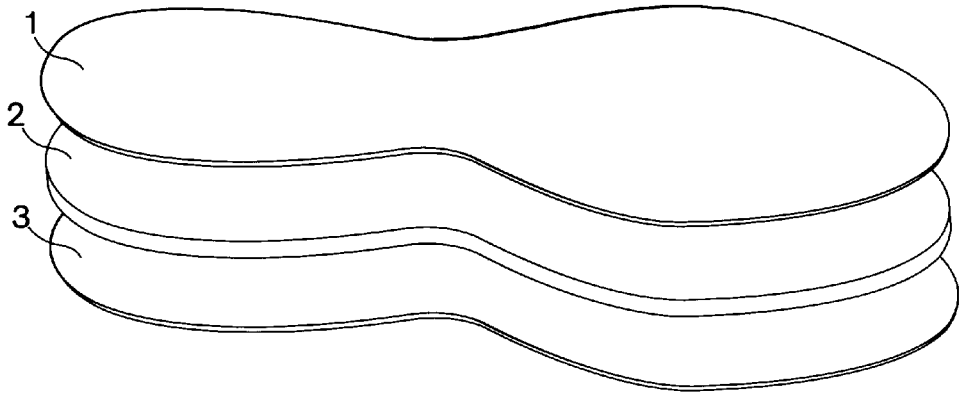
FIG. 1*a* is a perspective view of three components of a shoe sole.
Figure 1B:
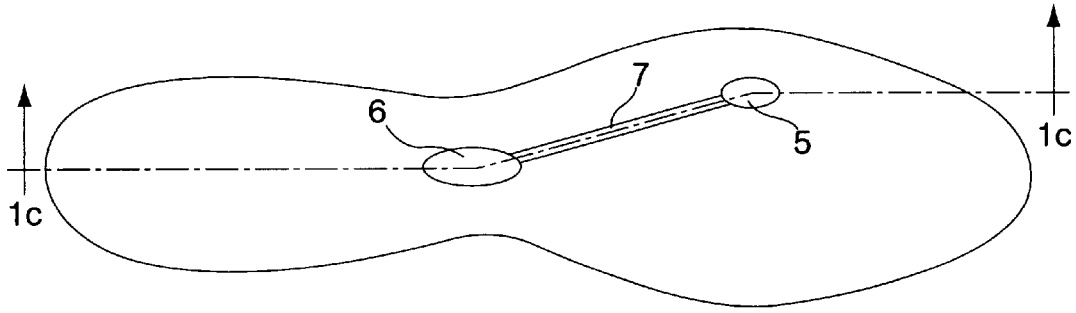
FIG. 1*b* is a top plan view of the outer sole with one embodiment of the device of the present invention in place.
Figure 1C:
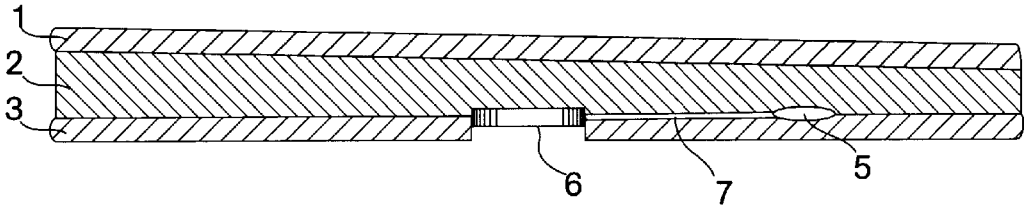
FIG. 1*c* is a cross sectional view taken along the line 1*c*—1*c* FIG. 1*b*.

The invention is a built-in, electronic component, wear-indicator device that when installed in an athletic shoe, during the manufacturing process, makes the shoe capable of signaling to the user the extent of wear and the progressive loss of cushioning and shock-absorption capability and the need to replace the shoe.

The wear indicator device comprises a sensor and a microprocessor or controller (with a power supply) which is capable of measuring and reporting the use-history of the shoe which shows the consumer the current point in the shoe's life cycle. The wear indicator preferably is installed between the midsole and outer sole during the manufacturing process or located in the inner sole when it is inserted during assembly although other locations can be used.

THE SENSOR AND MICROPROCESSOR

The device of the present invention has a sensing device and a microprocessor or controller that counts, remembers and reports the number of deformation cycles which occur as a result of any athletic shoe use which involves impact. This includes, but is not limited to, running, walking, hiking, aerobic exercise classes, aerobic dance classes, tennis, basketball, racquetball and the like.

A "deformation cycle" can be defined as the deformation that occurs in the athletic shoe sole as a result of any athletic activity involving impact and generally involves:

1. The heel strike and resulting compression of the heel area of the sole.
2. The ball strike and resulting compression of the ball area of the sole, expansion of the heel area of the sole, angular deformation of the heel-to-sole line.
3. The foot off the ground and resulting expansion of the ball area of the sole, and minimal angular deformation of the heel-to-sole line, i.e. a return to original axial shape.

COUNTING DEFORMATION CYCLES TO MEASURE SOLE FATIGUE

The sensor and microprocessor or controller in the present invention counts the number of deformation cycles or foot strikes that the shoe has experienced during regular use such as running, walking or jumping. In other words, the invention measures the use history of the shoe. The premise is that the degradation of the shoe's capacity to absorb shock is correlated with the number of deformation cycles or foot strikes the shoe has experienced, the more foot strikes the more degradation in the shoe's capacity to absorb shock. The more degradation in the shoe's capacity to absorb shock the less remaining shoe life. The measuring device via its display module, visually indicates to the user when it is likely that the shoe's capacity to absorb shock has substantially deteriorated and the shoes should be replaced.

It is important to note that the measuring device in several of the embodiments does not specify the precise area of the mid-sole that has lost its ability to absorb shock. In one embodiment, however, the precise location of the midsole wear or shock absorbing capabilities can be determined. The precise location of the loss will vary depending on the runner's gait. For some users this may be the outside heel area, for others the inside heel area and so forth.

The sensor and microprocessor or controller of the present invention counts the number of deformation cycles by counting:

1. The number of heel area compressions or expansions, or
2. The number of ball area compressions or expansions, or
3. The number of axial angular deformations, or
4. The number of motions of a specified characteristic for which the device is programmed, or
5. The number of pressure cycles detected in the fluid filled bladder containing a gas or liquid based medium, or the number of changes in volume in the bladder, or
6. The counting of some other physical characteristic occurring during each cycle for which the microprocessor or controller in the device is programmed such as an accelerometer which is actuated by a rotatable plate suspended between two torsion bars.

Both the sensor and the microprocessor or controller of the invention are very flexible with respect to placement. The sensor can be located in any area of the outsole, midsole or insole where it can be covered or embedded. Similarly, the microprocessor can be located anywhere on the shoe that does not disturb functionality, including the upper.

THE WEAR INDICATOR DISPLAY

Shoes equipped with the device of the present invention have a wear indicator display installed in a location easily visible to the user and which does not disturb the functionality of the shoe. Similar in principle to the fuel gauge on an automobile, it lets the user know the extent of midsole wear at a given point in the useful life of the shoe. The wear indicator display is extremely flexible with respect to placement location on or in the shoe. It is also flexible with respect to size and shape. For example, a particular athletic shoe manufacturer may decide to have the wear indicator display embody their logo and install it as a heel-plug module during manufacture. Alternatively, another manufacturer's marketing department may adopt the logo embodiment but want the indicator placed in the arch area on the side of the shoe for enhanced visibility and to accentuate its novelty, particularly during the early stages of introduction to the market. The indicator is flexible and can be adapted to the host manufacturer's particular needs.

THE POWER SOURCE

The device of the present invention can be powered by either battery or quartz crystal or similar small power source. Also contemplated is to capture and store energy from the flex of the shoe, converting this bio-mechanical energy to power the device or solar power derived from the shoe's exposure to the sun.

Similar to the sensor and indicator, there is great flexibility as to the placement of the power source. It may be placed anywhere in the midsole during manufacture and can also be placed in the upper in a location which does not interfere with the functionality of the shoe.

DESCRIPTION OF PREFERRED EMBODIMENTS

In one embodiment of the present invention shown in FIGS. 1*a* to 1*e* a built-in, electronic component, wear-indicator device is physically integrated into a running shoe, aerobics shoe or cross-training shoe where the ability to absorb shock throughout the functional life of the shoe is an integral performance characteristic of said shoe. The device is placed in either the right or left shoe during the manufacturing process. It is unnecessary in this particular embodiment that it be placed in both shoes.

Referring to FIGS. 1*a* to 1*f*, a device is shown that includes five electrical components: a sensing module 5 with an impact sensor and a visual display module, a power supply and ASIC (application specific integrated circuit), all housed in the function module 6. Wire leads 7 connect the sensing module 5 to the function module 6. The sensing module 5 comprises an impact sensor. Wire leads 7 connect the sensing module 5 to the function module 6 enabling the sensing module 5 to communicate with the function module 6 and enabling the function module 6 to provide power to the sensing module 5. A power source 9 provides power to the device.

In this embodiment, the sensor is placed between the outsole 3 and midsole 2 at the ball area of the foot during manufacture. The insole 1 has no contact with the device. The function module (which includes the ASIC, the visual display and the power source) is located in an axial position in the front of the arch area between the ball of the foot and the arch area in the center bottom of the shoe. The function module is located in a pocket area 6a cut out of the outer sole 3 and is recessed so as to avoid abrasion from repetitive and continuous ground contact.

The ball area is selected for this embodiment because aerobic activities such as aerobic dance or basketball do not always involve heel strikes. Indeed, an aerobics class which includes a significant amount of jumping and/or dance movements may miss heel strikes as much as 40% of the time. While most runners strike the heel with every deformation cycle, they strike different areas of the heel and some runners are "light heel strike or heavy ball strike" runners. These variables are governed by the unique biomechanics and running style of the individual. The ball area almost always makes ground contact with every deformation cycle and is subject to less variability than the heel strike zone. Therefore, in this particular embodiment of the device the impact sensor is placed in the ball area between the outsole and the midsole during manufacture.

However, the sensor is flexible with respect to its placement location on the sole of the shoe. Therefore, if a particular athletic shoe application requires impact sensor placement in a different location (heel, arch, toe, or any other area of the sole) this can be readily accommodated.

The impact sensor requires a certain minimal level of deformation to register a deformation cycle. Further, continuous deformation, which could result from standing with one's body weight predominantly on one foot, will not result in false positives. The impact sensor and the ASIC work together to register, record and remember the number of deformation cycles that the athletic shoe has experienced. A particular type of athletic shoe has a certain maximum, useful life which can be expressed in deformation cycles and can be determined by the manufacturer. The ASIC is programmed to remember and communicate the number of deformation cycles to the function module in order to communicate the extent of shoe wear to the user.

Figure 1D:
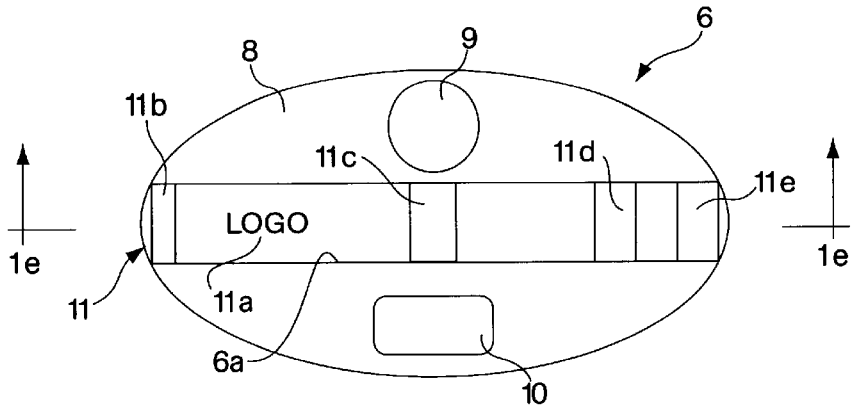
FIG. 1*d* is a plan view of an embodiment of a function module which may be used with the device of the present invention.
Figure 1E:
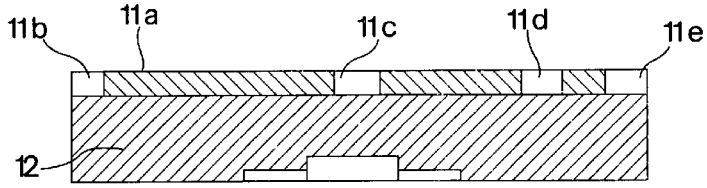
FIG. 1*e* is a cross sectional view taken along the line 1*e*—1*e* of FIG. 1*d* of an embodiment of a function module which may be used with the device of the present invention.
Figure 1F:
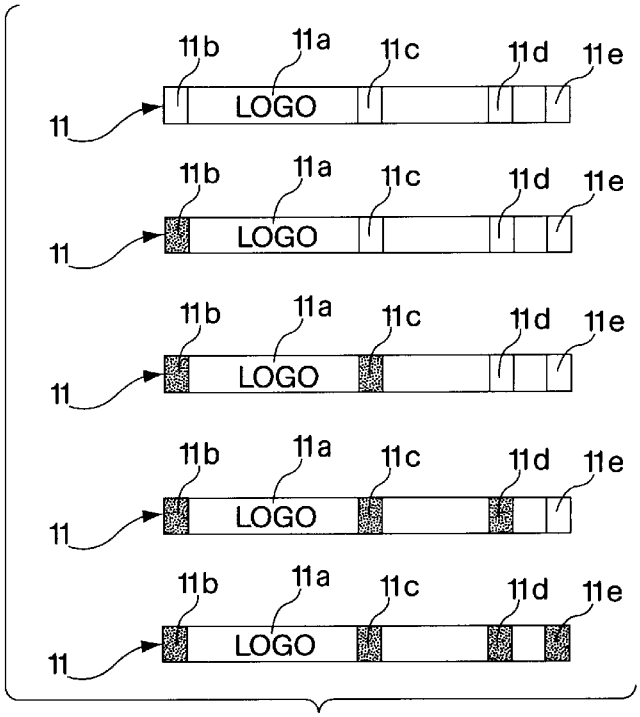
FIG. 1*f* shows partial plan views of the indicia indicating progressive stages of use of the shoe.

As shown in FIGS. 1*d* and 1*e*, the display module 11 is disposed within the function module 6. The display module 11 includes a liquid crystal array. The array includes at least one segment 11*a* which provides a base for a manufacturer's logo. The following utilization schedule is exemplary of one which may be useful to both the wearer and the manufacturer. For example, in the case of a running shoe application the ASIC is programmed to send its first message to the display module upon the shoe reaching five percent of its useful life or 10,000 deformation cycles. The message is to darken an area 11*b* of a display bar (to be described hereinafter) on the display module. This lets the user know the device is working and becomes a "consumer confidence indicator" and advises the user that the device is functioning properly. At fifty (50) percent of the useful life or 250,000 deformation cycles the ASIC sends a second message to the display module to darken a second, separate area 11*c* on the display bar indicating "nearing replacement" or letting the consumer know that it is time to replace the shoe if they are an "early replacement" user. This is a user who (1) has a history of back, hip, knee or ankle problems and therefore needs maximum shock absorption from their shoes at all times or (2) has an unusual gait that accelerates wear of the midsole in a concentrated area and which has not or cannot be corrected by orthotics or (3) is significantly overweight or a heavy footed user or (4) is a competitive athlete and therefore, must have optimal shock absorption from their shoes at all times. At eighty (80) percent of useful life or 400,000 deformation cycles the ASIC sends a third message to the display module to darken a third and a fourth separate area 11*d* and 11*e* on the display bar indicating "regular replacement" or letting the typical consumer know that it is now time to replace the shoe. At one-hundred (100) percent of useful life or 500,000 deformation cycles the ASIC sends a fourth message to the display module to darken areas 11*d* and 11*e* on the display bar indicating "late replacement" or letting the consumer know that the shoes are no longer fit for their intended purpose. At this point, even a small person or a relatively light person should replace the shoe.

Figure 2:
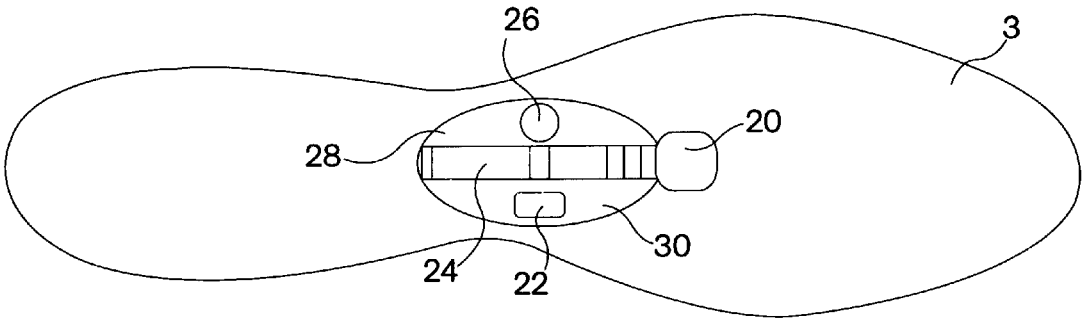
FIG. 2 is a top plan view of the outer sole with another embodiment of the device of the present invention in place.

Another embodiment of the invention is shown in FIG. 2 and includes a built-in, electronic component, wear indicator device physically integrated into an athletic shoe. As with the previous embodiment, the device is placed in either the right shoe or the left shoe during the manufacturing process.

This embodiment differs from the previous embodiment in that the entire device is housed in one function module. That is, the impact sensor 20, the ASIC 22, the visual display 24 and the power source 26 are all housed together eliminating the need for electric wires connecting the sensor module to the display module as described in the previous embodiment.

The impact sensor 20 housed within this single unit requires a certain minimal level of deformation to register a deformation cycle. Further, continuous deformation, which could result from standing with one's body weight predominantly on one foot, will not result in false positives. The impact sensor and the ASIC work together to register, record and remember the number of deformation cycles that the athletic shoe has experienced. A particular type of athletic shoe will have a certain useful life which can be expressed in deformation cycles and which is determined by the manufacturer. The microprocessor 22 is programmed to remember and communicate the number of deformation cycles to the visual display 24 in order to communicate the extent of shoe wear to the user. For example, as with the previous embodiment, the same utilization schedule described above may be used.

Figure 3A:
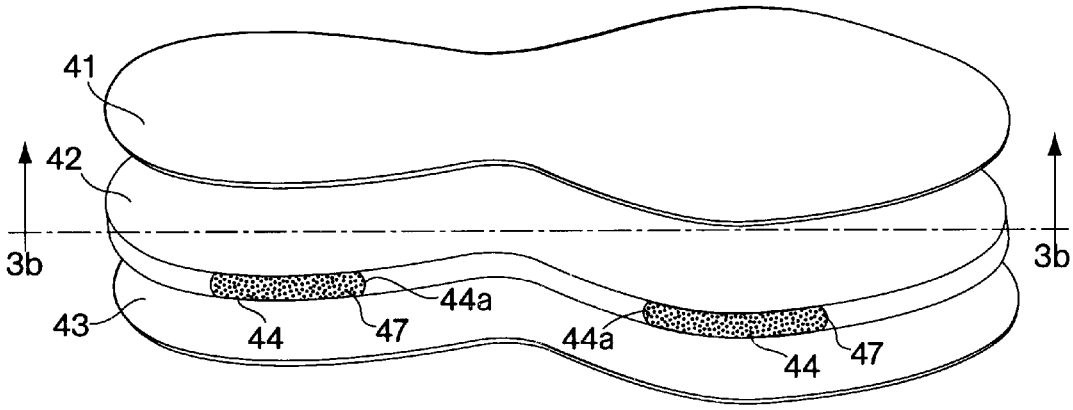
FIG. 3*a* is a perspective view of three components of a shoe sole.
Figure 3B:
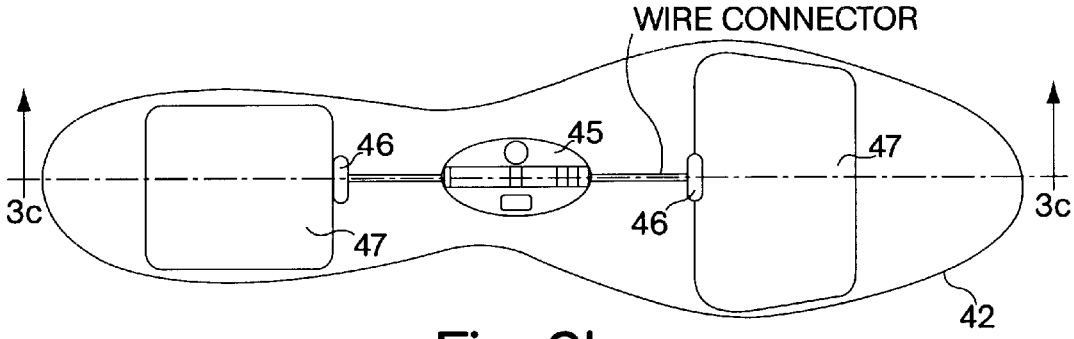
FIG. 3*b* is a top plan view of the midsole with one embodiment of the device of the present invention in place.
Figure 3C:
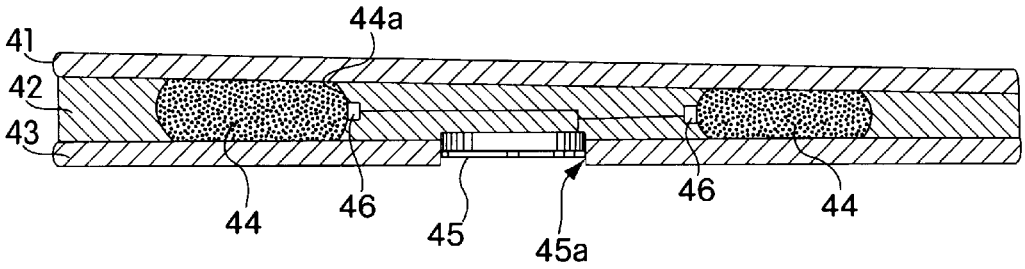
FIG. 3*c* is a cross sectional view taken along the line 3*c*—3*c* of FIG. 3*b*.

The impact/compression embodiments described above may also be applied to a gas or liquid based medium, as shown in FIGS. 3*a*–3*c*. If a particular shoe application calls for a gas or liquid filled cavity in the sole, the device of the present invention will measure cycles by detecting changes in the volume of the fluid-filled cavity, of a specified threshold or by measuring the change in pressure which occurs with the change in volume associated with a step cycle.

Similarly as with the embodiment shown in FIG. 1*a*, the insole three layers, an outsole 43 a midsole 42 and an insole 41. Fluid filled bladders 47 containing liquid or gas are disposed in pockets 44*a* within the midsole. A function module 45 (which includes the ASIC, the visual display and the power source as described previously) is located in the midsole 42 in an axial position in the front of the arch area between the ball of the foot and the arch area in the center bottom of the shoe. Pressure sensitive detectors 46 are connected to each of bladders 47 and also to function module 45, as described previously. The function module is located in a pocket area 44*a* cut out of the outer sole 43 and is recessed so as to avoid abrasion from repetitive and continuous ground contact.

Figure 4A:
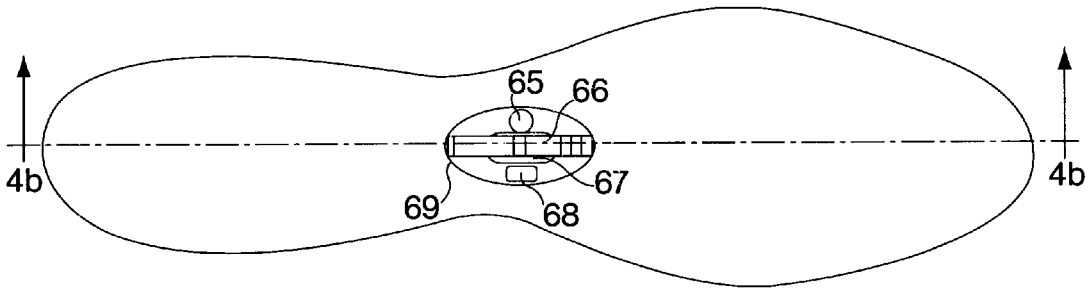
FIG. 4*a* is a top plan view of another embodiment of the present invention where an accelerometer is disposed in the midsole to provide the measurements.
Figure 4B:
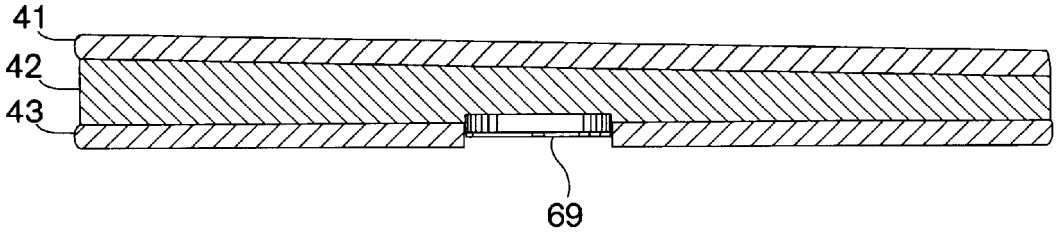
FIG. 4*b* is a cross sectional view taken along the line 4*b*—4*b* of FIG. 4*a*.

In another embodiment, shown in FIGS. 4*a* and 4*b*, a built-in, electronic component, wear-indicator device physically integrated into a shoe where the ability to absorb shock throughout the functional life of the shoe is an integral performance characteristic of said shoe. The device is placed in either the right shoe or the left shoe during the manufacturing process. This embodiment is similar to the other embodiments in that the entire device is housed in a single unit. That is, the sensor 67, the ASIC microprocessor 68, the visual display 66, and the power source 65 are all housed together as a unit 69, eliminating the need for electric wires connecting the sensor module to the function module. However, in this embodiment the sensor 67 is a motion sensor (or accelerometer) as shown in FIGS. 5*a* and 5*b*.

Figure 5A:
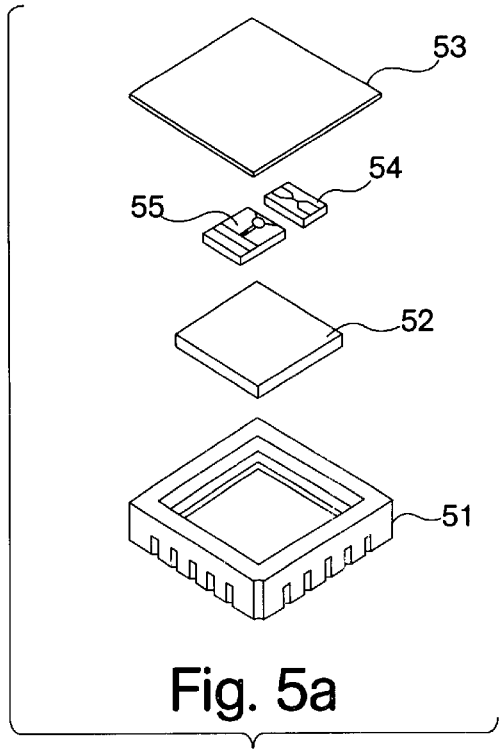
FIG. 5*a* is an exploded view of an electronic component useful in the sensing device of the present invention.
Figure 5C:
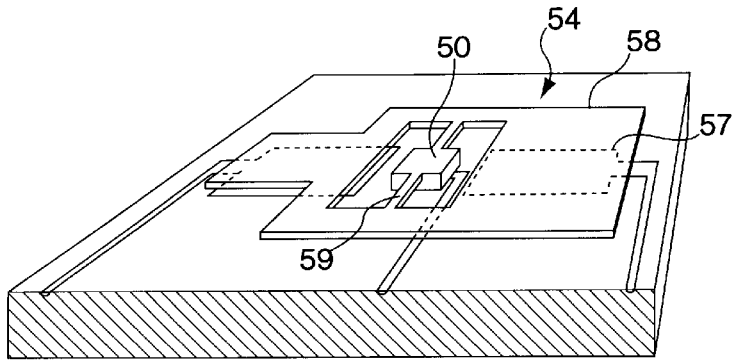
FIG. 5*c* is an enlarged perspective view of the sense element chip shown in FIG. 5*a*.
Figure 5B:
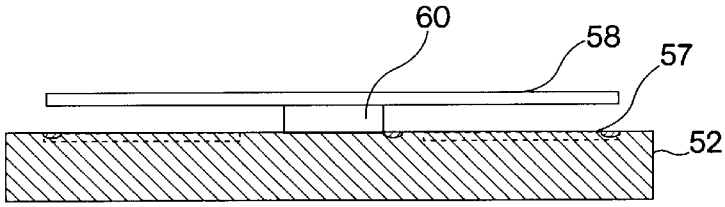
FIG. 5*b* is a cross sectional view.

In FIGS. 5*a* and 5*b*, the accelerometer is encased in a housing including a ceramic chip carrier 51, a substrate 52 and a lid 53. A sense element 54 is electrically connected to the electronic chip 55 described previously, the ASIC. The sense element includes the substrate 52 upon which is mounted a lower, fixed capacitor plate 57 and an upper, mobile capacitor plate 58. A pedestal support 50 is suspended between two torsion bars 59. A pedestal 60 is disposed between the pedestal support 58 and the substrate 52 whereby to transmit signals of torsional changes in the pedestal 60 to the ASIC 55.

The accelerometer detects motion and counts stepping cycles associated with running, walking, aerobics and other exercise activity. It does so by recording the linear acceleration of a specified magnitude or "threshold magnitude" that occurs when the foot, from the non-ground contact raised position, travels forward and vertically, downward to the ground contact position. The threshold magnitude is set to avoid the false positives associated with motion that is collateral to the intended use of the shoe such as the motion associated with the shoe traveling in a suitcase or gym bag.

The accelerometer and ASIC work together to register, record and remember the number of motion cycles that the athletic shoe has experienced. A particular type of athletic shoe will have a certain useful life which can be expressed in motion cycles and which is determined by the manufacturer. The microprocessor is programmed to remember and communicate the number of motion cycles to a liquid crystal display to communicate the extent of shoe wear to the user.

The single unit device comprising the motion sensor, the ASIC, the liquid crystal display and the power source is located in an axial position in the front of the arch area between the ball of the foot and the arch area in the center bottom of the shoe. The function module is located in a pocket area cutout of the outer sole and is recessed so as to avoid abrasion from repetitive and continuous ground contact. However, the unit can be mounted in any other area of the shoe that does not interfere with the shoe's functionality.

Figure 6:
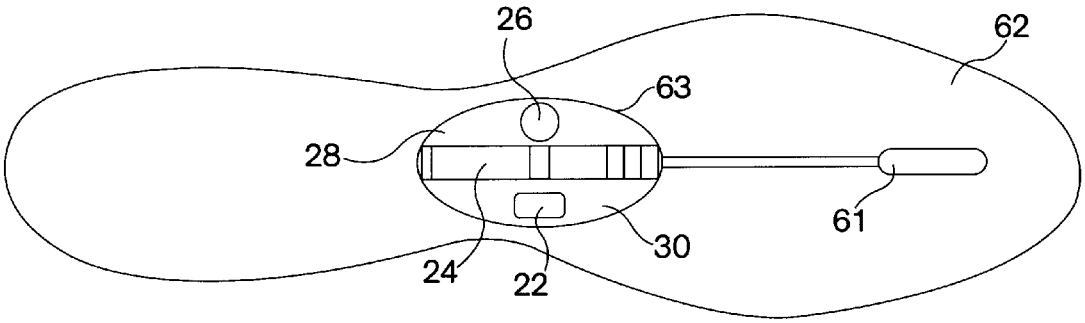
FIG. 6 is a plan view of another embodiment of the present invention wherein an axial angle deformation sensor is disposed in the midsole to detect and measure axial deformation of the midsole and relay the data to an electronic chip.

Another embodiment of the present invention is shown in FIG. 6. This embodiment of the device is a built-in, electronic component, wear indicator device physically integrated into a shoe where the ability to absorb shock throughout the functional life of the shoe is an integral performance characteristic of said shoe. Again, the device of the present invention is placed in either the right or left shoe during the manufacturing. This embodiment includes the function module 63 comprising the sensor, the ASIC, the visual display and the power source. However, in this embodiment sensing device 61 registers axial angular deformation which occurs in different areas of a shoe as a result of a step cycle. A shoe at rest, that is, with the foot placed in the shoe but without stepping motion has a readily determined superior to inferior (toe to heel) axial angle that changes in degree in both the sole and the upper, when a step is taken. The sensing device 61 disposed in the midsole 62 and registers this flexure or axial angle deformation of a specified threshold which occurs in the sole and the upper and transmits it to the function module 63. The ASIC counts and remembers the number of axial angular deformation cycles.

The axial angular deformation sensor and ASIC work together to register, record and remember the number of axial angular deformation cycles that the athletic shoe has experienced. A particular type of athletic shoe will have a certain useful life that can be expressed in axial angular deformation cycles and which is determined by the manufacturer. The microprocessor is programmed to remember and communicate the number of axial angular deformation cycles to a liquid crystal display to communicate the extent of shoe wear to the user. This embodiment can be mounted in any area of the shoe that does not interfere with the shoe's functionality.

The prior embodiments measure athletic shoe sole wear using a correlational approach, that is, the approach assumes that number of deformation cycles is correlated with athletic shoe sole wear. Therefore, by counting deformation cycles of a particular shoe one can determine the progressive loss in shock absorption capability of the shoe's midsole throughout the shoe's useful life.

It is apparent that changes and modifications can be made within the spirit and scope of the present invention, but it is our intention only to be limited by the following claims.

As our invention we claim:

1. An athletic shoe comprising:

an upper portion of said shoe and a lower portion, said lower portion being flexible and providing cushioning to a wearer of said shoe, said lower portion comprising a sole, said sole comprising an outer sole, a midsole and an inner sole;

sensing means disposed in said sole to detect progressive loss of flexibility and cushioning of said sole based upon the number of times it has been actuated;

means to collect data from said sensing means and transmit said data to an indicia bearing means to display progressive loss of flexibility and cushioning of said sole and means to provide power to said means to detect progressive loss of flexibility and cushioning in said sole and said indicia bearing means;

means electrically connecting said detection means, display means and said means to provide power.

2. The shoe according to claim 1 wherein the means to detect progressive loss of flexibility and cushioning of said sole, the indicia bearing means and said power means are all disposed in a function module.

3. A shoe according to claim 2 wherein a sensing module is disposed adjacent the ball area of said insole and said function module is disposed adjacent the arch area of said insole and further includes connection means between said sensing module and said function module.

4. The shoe according to claim 2 wherein said indicia bearing means includes an illuminated strip formed of illuminated segments adapted to extinguish progressively upon receiving signals from said sensing means that a predetermined number of actuation times has been registered.

5. The shoe according to claim 4 further including a manufacturer's logo on said strip.

6. The shoe according to claim 2 wherein the function module further includes a sensing module, all disposed adjacent the arch area of said insole and connection means between said sensing module and said function module.

7. The shoe according to claim 1 wherein the sensing mean detects axial angle deformation, said sensor being located in the ball area of the sole and arranged to transmit signals to said function module.

8. The shoe according to claim 2 wherein the sole contains at least one fluid containing bladder and a sensing means to detect cycles of changes in pressure in said bladder and a means to collect data from said sensing means and transmit said data to said indicia bearing means to display progressive number of cycles.

9. An athletic shoe comprising:

an upper portion of said shoe and a lower portion, said lower portion being flexible and providing cushioning to a wearer of said shoe, said lower portion comprising a sole, said sole comprising an outer sole, a midsole and an inner sole, said lower portion progressively losing flexibility and cushioning during use;

sensing means disposed in said sole to detect progressive loss of flexibility and cushioning of said sole based upon the number of times it has been actuated;

means to collect data from said sensing means and transmit said data to an indicia bearing means to display progressive loss of flexibility and cushioning of said sole, and means to provide power to said means to detect progressive loss of flexibility and cushioning in said sole and said indicia bearing means, said indicia bearing means and said power means all being disposed in said sole together with means electrically connecting said detection means, said display means and said means to provide power, said function module being disposed in said midsole and is visible through said outer sole.

10. An athletic shoe comprising:

an upper portion of said shoe and a lower portion, said lower portion being flexible and providing cushioning to a wearer of said shoe, said lower portion comprising a sole, said sole comprising an outer sole, a midsole and an inner sole, said lower portion progressively losing flexibility and cushioning during use;

sensing means disposed in said sole to detect said progressive loss of flexibility and cushioning of said sole based upon the number of times it has been actuated;

means to collect data from said sensing means and transmit said data to an indicia bearing means to display progressive loss of flexibility and cushioning of said sole and means to provide power to said means to detect progressive loss of flexibility and cushioning in said sole and said indicia bearing means;

a function module containing said means to detect said progressive loss of flexibility and cushioning of said sole, said indicia bearing means and said power means; and means electrically connecting said detection means, display means and said means to provide power.

* * * * *